US005375417A

United States Patent [19]

Barth

[11] Patent Number: 5,375,417

[45] Date of Patent: Dec. 27, 1994

[54] METHOD OF AND MEANS FOR DRIVING A PNEUMATIC ENGINE

[76] Inventor: Wolfgang Barth, Am Schellenfeld 2, 8532 Bad Windsheim, Germany

[21] Appl. No.: 165,008

[22] Filed: Dec. 9, 1993

Related U.S. Application Data

[63] Continuation of Ser. No. 54,468, Apr. 27, 1993, abandoned, which is a continuation of Ser. No. 696,181, May 6, 1991, abandoned.

[30] Foreign Application Priority Data

May 4, 1990 [DE] Germany ..... 4014372
Oct. 4, 1990 [DE] Germany ..... 4031324

[51] Int. Cl.[5] ..... F16D 31/02

[52] U.S. Cl. ..... 60/370; 60/371; 60/408; 92/134

[58] Field of Search ..... 60/370, 371, 408; 92/134

[56] References Cited

U.S. PATENT DOCUMENTS 380,375 4/1888 Williams et al. .
626,368 6/1899 Crane .
3,925,984 12/1975 Holleyman .
4,563,941 1/1986 Soendergaard .

FOREIGN PATENT DOCUMENTS 0044738 1/1982 European Pat. Off. .
1007383 10/1965 United Kingdom .
1046882 10/1966 United Kingdom .
1064887 4/1967 United Kingdom .

*Primary Examiner*—Edward K. Look
*Assistant Examiner*—F. Daniel Lopez
*Attorney, Agent, or Firm*—Darby & Darby

[57] ABSTRACT

A pneumatic motor having a plurality of cylinders, with each cylinder having an expansion chamber (15), defined in part by a piston plate (2); and a diversion chamber (16) which is divided into two chambers by a slide plate (11), with the diversion chambers connected to a pressure supply line (27) and to a pressure diversion line (28). The piston plate is connected to a piston rod (5) by a lock (3). The expansion chamber holds an amount of compressed air held constant throughout the operation cycle. Expansion of the expansion chamber moves the piston plate and piston rod (5) to rotate a crankshaft (5*a*). At the end of the expansion stroke, the piston rod is disconnected from the piston plate. The expansion chamber is compressed by pressurizing the diversion chamber below the slide plate (11), forcing the slide plate and push rods (7) upwards, which pushes the piston plate upwards, until the piston plate can be held at a top position by a lock (3'). The diversion chamber below the slide plate is pressurized by pressurized air from diversion chambers of cylinders in which the expansion chamber has been compressed, along with supplemental air from a compressor (30).

7 Claims, 6 Drawing Sheets

METHOD OF AND MEANS FOR DRIVING A PNEUMATIC ENGINE

This is a continuation of U.S. patent application Ser. No. 08/054,468, filed Apr. 27, 1993, now abandoned, which was a continuation of U.S. patent application Ser. No. 07/696,181, filed May 6, 1991, now abandoned.

BACKGROUND OF THE INVENTION

The present invention relates to a new method of and means for driving a pneumatic engine.

This novel method may replace any type of conventional spark-ignition engine, compression-ignition engine or other internal combustion engine.

All of the prior art methods of and means for driving engines present the disadvantage of working at relatively low efficiency.

SUMMARY OF THE INVENTION

The present invention is intended to provide a method and means for realization of the method characterized in that it includes a system that permits an increase of the efficiency factor compared to the prior art engines by exploiting the driving energy more economically and efficiently.

According to the invention the advantage results from the fact that, during the actuating stroke, energy is stored to be used in the next actuating stroke, with the consequence that once the starting-up period is terminated, energy can be saved.

The enclosed Table A lists the percentages of stored pressure which can be acquired in the course of a regular power stroke after the starting phase of the engine is completed.

DETAILED DESCRIPTION OF THE INVENTION

Figure 5:
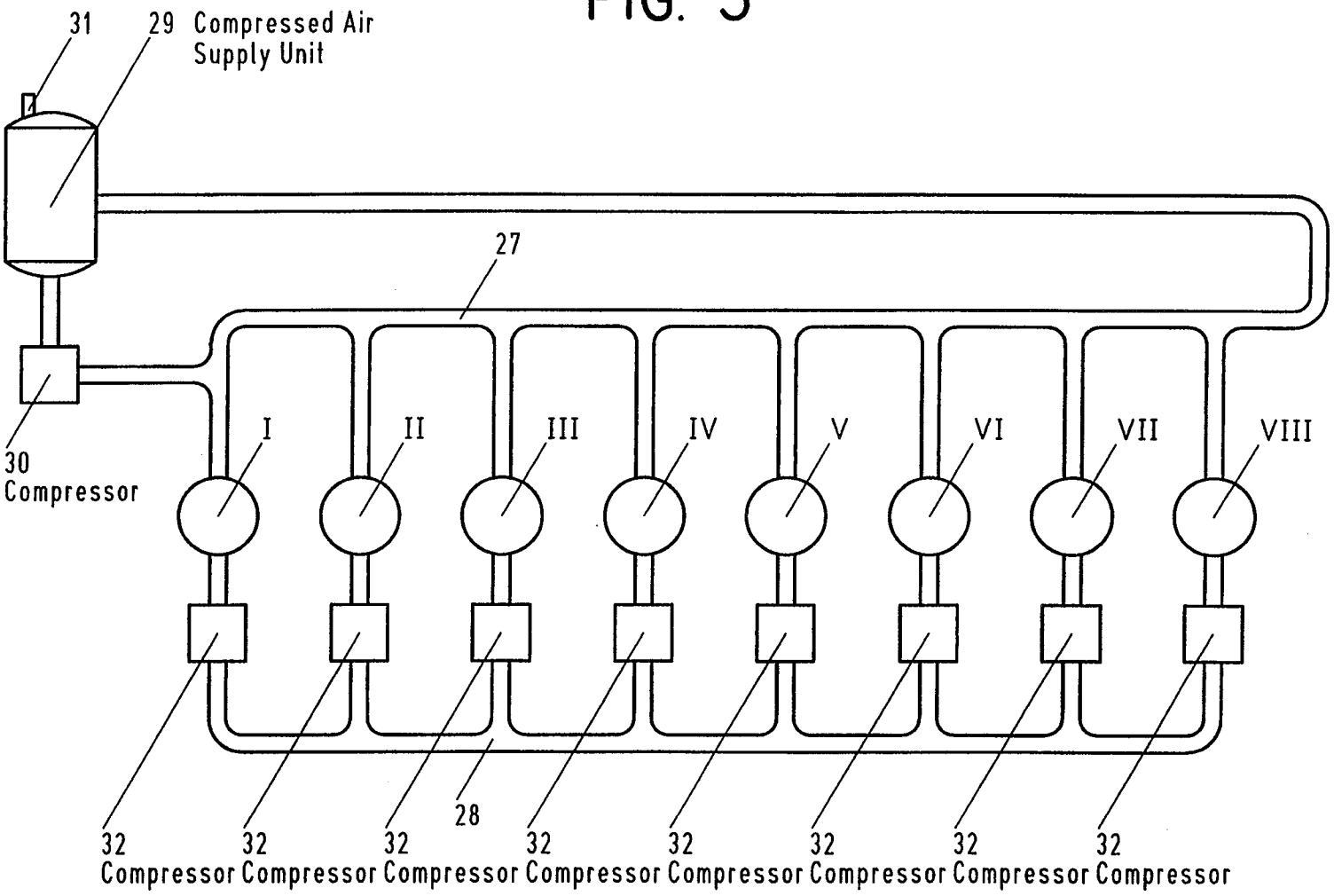
FIG. 5 depicts, in substantially schematic form, an arrangement of eight actuating cylinders combined to form an actuating unit, and depicting associated components for the actuating unit.
Figure 1A:
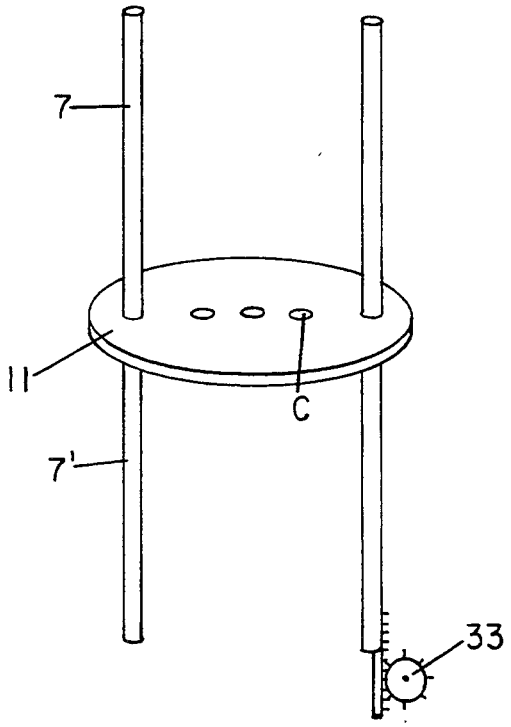
FIG. 1*a* is an exploded perspective view of a slide piston plate and push rods mounted thereto, which is mounted in the cylinder.

The method of driving an aerostatic engine using an energy saving system is based on the principle of a drive system which contains a large number, e.g., eight, actuating cylinders (I–VIII) which are connected in line as shown in FIG. 5.

Figures 1, 6:
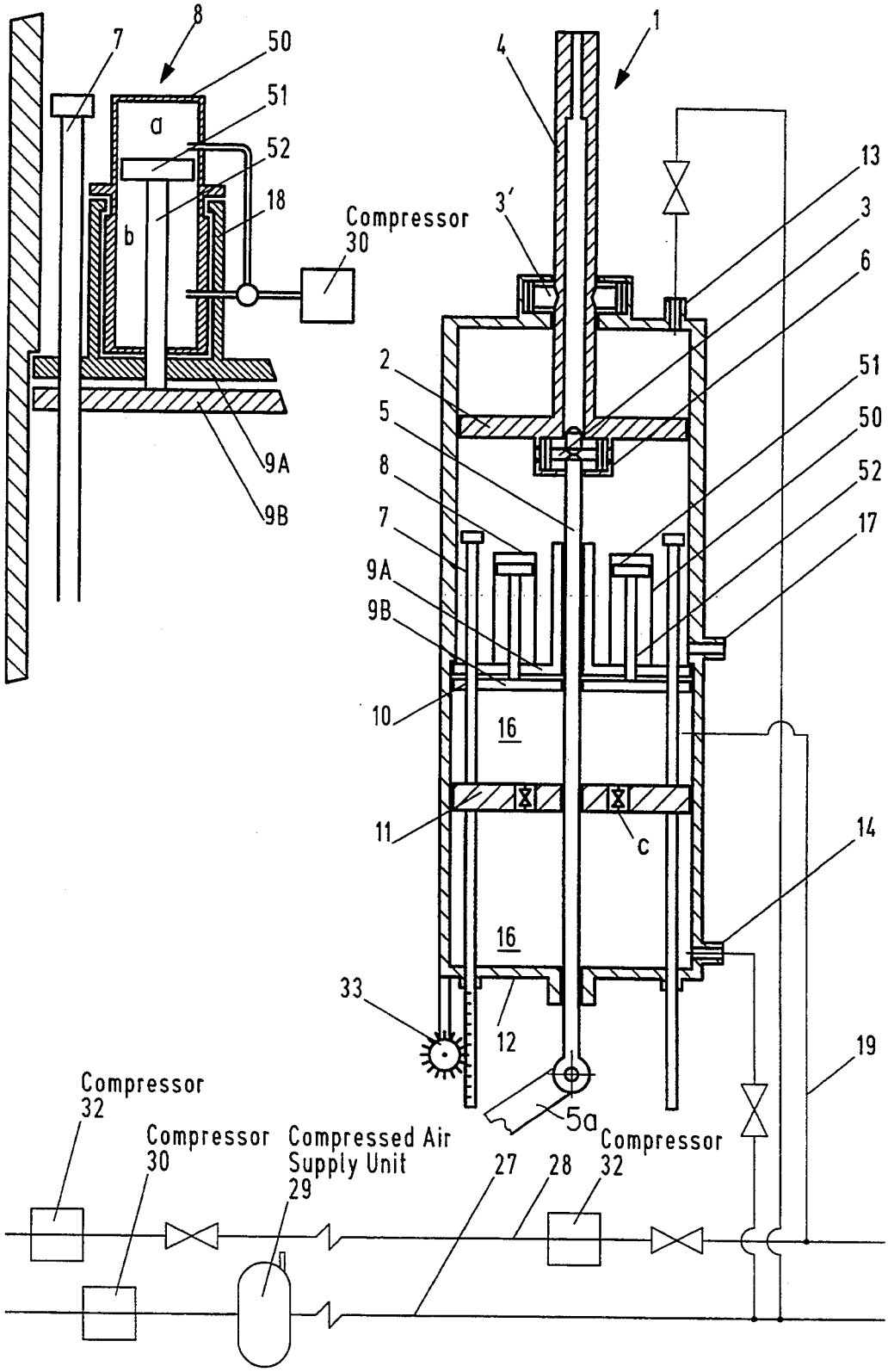
FIG. 1 is a cross-sectional, partially schematic view of one of the actuating cylinders which is to be connected in line with other cylinders in the pneumatic engine of the present invention.
FIG. 6 is an exploded, partially cross-sectional, partially schematic view of one of a pair of control cylinders employed to move a lower slide plate with respect to an upper slide plate in the cylinder.

As is shown in FIG. 1, each of the illustrated six actuating cylinders I–VI, which are connected in line, comprises a shut off pressure expansion chamber 15 in which a quantity of compressed air, which is invariable throughout the entire-course of operation, and which imparts the aerostatic pressure, built up prior to the actuating stroke, to the slide piston plate 2. The slide piston plate 2 is detachably connected to the piston rod 5 via a locking device 3 inside locking breech 6, which in turn transmits the force provided to the piston such as by a crank shaft 5*a* of any conventional drive mechanism (not shown) which includes suitable timing, such as by a conventional cam shaft between the pistons of the different cylinders to the connecting device of the actuating cylinder. The aerostatic pressure built up in pressure expansion chamber 15 prior to the actuating stroke causes the slide piston plate 2, once it is released from locking engagement with the cylinder, to shift downwardly until the aerostatic pressure in pressure expansion chamber 15 is reduced, typically to 50%, of its initial value, with the piston plate doing work at the same time. Each of the actuating cylinders I–VIII includes, in the section beneath the slide piston plate 2, a pressure diversion chamber 16, which on one end is connected to a pressure supply line 27, which is in turn connected to an external compressed-air supply unit 29, and the compressed air supply unit is connected via solenoid valves to the pressure diversion chambers 16 of the remaining actuating cylinders. The pressure diversion chamber is connected on its other side to a pressure diversion line 28, which is in turn connected via solenoid valves to the pressure diversion chambers 16 of all the other actuating cylinders I–VIII in such a way that the operating fluid compressed in the pressure diversion chamber 16 during the preceding compression stroke is allowed to expand from the pressure diversion chamber 16 to be stored via the pressure diversion line 28 in the pressure diversion chamber 16 of the next actuating cylinder. The pressure diversion line 28 connects the pressure diversion chambers in a way such that, in order to restore the aerostatic pressure in pressure expansion chamber 15 for one part, the operating fluid stored in the pressure diversion chambers 16 of all following actuating cylinders can be added to pressure diversion chamber 16 via pressure diversion line 28 controlled by means of solenoid valves, and, for the other part, the operating fluid still required to restore the full initial compression in pressure expansion chamber 15 can be provided by the external compressed-air supply unit 29 via the pressure supply line 27. This has the result that slide piston plate 2, acting as an actuating piston, is moved up again, producing the required aerostatic pressure in pressure expansion chamber 15 necessary for the next compression stroke.

If, as shown in the FIG. 5 preferred embodiments eight actuating cylinders I–VIII are used, substantially all, preferably 100%, of the required aerostatic pressure is built up in the pressure diversion chambers 16 of the first three actuating cylinders by the external compressed-air supply unit, with the third actuating cylinder III executing the actuating stroke in each case, while the operating fluid is first allowed to pass from the pressure diversion chamber of the first actuating cylinder to the pressure diversion chamber of its successors by activating the solenoid valve until, after equalization of the pressure, 50% of the aerostatic pressure is stored therein. The operating fluid is then permitted to pass to the pressure diversion chamber of the next actuating cylinder, where again 50% of the remaining aerostatic pressure is stored, and this process is repeated until, during regular operation, 80% of the operating fluid is stored for further use.

The remaining pressure required in the pressure diversion chamber 16 is transferred to the follow-up pressure diversion chamber by means of operating fluid that is provided by the pressure supply vessel.

In order to guarantee smooth running of the crankshaft, several units of actuating cylinders connected in line as described above may be applied in parallel.

For better understanding, Table A is based on the prerequisite that the values of pressure that can be stored within the pressure diversion chambers 16 and the residual pressure that is necessary to restore the initial pressure in pressure expansion chamber 15 are provided in form of injected energy to the system by a compressor injecting atmospheric air via pressure supply line 27 into pressure diversion chamber 16 after the actuating stroke is completed.

Prior to pressure release, the pressure is passed at 10 bar (approx. 145 psi in a preferred embodiment) from a pressure diversion chamber 16 to a pressure diversion chamber 16 of the follow-up cylinder which is to be provided with a pressure of 10 bar (approx. 145 psi in a preferred embodiment) for full power. For this purpose, either one diversity compressor or several small diversity compressors 32 of a smaller kind may be used in the system.

According to Table A, the pressure is passed from the pressure diversion chamber 16 of the specific actuating cylinder I, in which the actuating stroke has just been terminated, to the pressure diversion chamber of, for example, the next cylinder III via the pressure diversion line 28, in which only the solenoid valves of pressure diversion chamber 16 of this first actuating cylinder, where the actuating stroke has just been terminated, are open to the pressure diversion chamber 16 of cylinder III in this example.

The equalization of pressure takes place according to the expression:

$$D=(a+b)/3=(100+0)/3=33 \text{ vol. } \%$$

where

D denotes the equalized pressure in percentage of volume.

a denotes the initial pressure in the actuating cylinder in which the actuating stroke has just been terminated.

b denotes the pressure in actuating cylinder III, which is zero at the beginning of the starting-up period.

The amount of energy required to compress the operating fluid that is to be transferred is equal to the energy expended by the small compressor;

$$D=(a+b)/2=50 \text{ vol. } \%$$

at an efficiency of coupling of 0.854 that can be attained due to the invention during operation time.

The pressure diversion chamber of the actuating cylinder that has just terminated the actuating stroke subsequent to the above described step of the process is, in the following step, connected to the pressure diversion chamber 16 of the next cylinder IV by setting the solenoid control valves correspondingly, at the same time storing $$D=(50+0)/2=25 \text{ vol. } \%$$

in the pressure diversion chamber of that cylinder after the equalization of pressure. This process is repeated continuously as seen in Table A.

As illustrated in FIG. 1, the actuating cylinder includes a slide piston plate 2, which, when fitted into the pressure expansion chamber 15, serves the function of an actuating piston, and can be locked, with locking device 3 in the locking breech 6, to the piston rod 5 running inside the guiding bore 4. The cylinder further contains, at a defined distance below slide piston plate 2, a slide piston plate 9 and a slide piston plate 11, the latter of the two provided with solenoid control valves c and push rods 7 running at right angles through it and rigidly attached to it, with their top sections guided via bulkhead hydraulic fittings through slide piston plate 9. A pressure diversion chamber 16, which is sealed with bottom plate 12, is also part of the actuating cylinder. The guiding bore 4, which is an integral part of slide piston plate 2, can be arrested by activating locking device 3'.

Slide piston plate 9 may be replaced by, or may comprise, as shown in the depicted preferred embodiment, two slide piston plates 9A and 9B, which include a control cylinder 8 (illustrated in FIG. 6). The cylinder housing 50 of the control cylinder 8 is rigidly attached to the top slide piston plate 9A and the reversibly controllable piston 51 of the control cylinder is mounted rigidly to the lower slide piston plate 9B via piston rod 52. The reversing of control cylinder 8 is effected by applying a pressure which has been either one side of its piston plate or the other. The push rods 7, which are mounted rigidly to slide piston plate 11 and which do not pass through slide piston plate 2, are allowed to slide through both slide piston plate 9A and 9B. The lower prolongations 7' of the push rods 7, which are allowed to slide through bottom plate 12, serve to prevent pressure from building up or being released as a result of the change in volume effected by the presence of sections of the push rods above slide piston plate 11, while slide piston plate 11 is moved up or down. All of the valves, switches and locking devices are controlled electrically.

In order to prevent the production of a vacuum between the slide piston plates 9A and 9B while they are moved apart, a valve is set open in slide piston plate 9A which connects the space between the slide piston plates 9A and 9B to atmospheric pressure.

Figure 7:
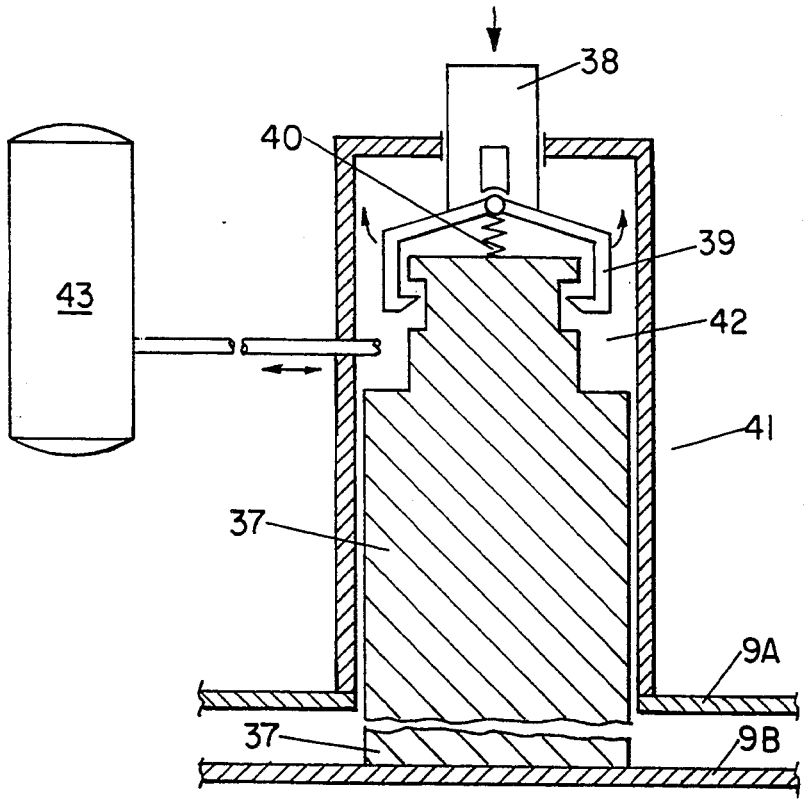
FIG. 7 is a cross-sectional view of an alternative preferred embodiment of a control cylinder in accordance with the present invention.

FIG. 7 illustrates one embodiment of a unidirectionally actuated control cylinder 41 that may be used to accomplish the transfer of pressure and may replace control cylinder 8. In the control cylinder 41 of FIG. 7, during the period when the pressure is released from pressure diversion chamber 16, and before the transfer of the residual pressure of said chamber is started, slide piston plate 2 rests constantly on release rod 38 thus spreading apart a gripping device 39 as the release rod 38 is provided with a backing spring 40 of low spring tension.

When the transfer of pressure from pressure diversion chamber 16 is started, the piston plungers 37 are moved upwards due to the displacement of slide piston plate 9B, and are arrested at the upper dead center of slide piston plate 9A and 9B as the gripping device 39 catches the piston plunger 37 at that moment, due to the fact that the mechanical pressure on release rod 38 exerted by slide piston plate 2 is taken away as soon as slide piston plate 11 together with its push rods 7 are moved vertically downwardly after the locking of slide piston plate 2 to slide piston plate 9 has taken place. Piston plunger 37 does not move downwardly before the pressure in pressure diversion chamber 16 has decreased to a certain level. When the pressure in pressure diversion chamber 16 starts to increase again, the piston plungers 37 are pushed into their cylinders due to the slide piston plate 9A and 9B being moved upwardly and are arrested at upper dead center of the slide piston plates 9A and 9B, which are adjacent at that moment. The action of slide piston plate 11 brings up slide piston plate 9B adjacent to slide piston plate 9A, and then pushes both of them upwardly, with gripping device 39 catching piston plunger 37 as soon the mechanical pressure on release rod 38 is released. Compression chamber 42 of the unidirectionally actuated control cylinder 41 is connected via a pressure line to a pressure vessel 43, the volume of which is larger by a multiple than the volume of compression chamber 42, in order to prevent the pressure in pressure diversion chamber 16 from decreasing during the process of transfer of pressure.

The top cover of the cylinder is provided with a pressure pipe socket 13, which connects pressure expansion chamber 15 via pressure supply line 27 to an external compressed-air supply unit 29. Pressure diversion line 28 is connected to pressure diversion chamber 16 via pressure line 19.

The side wall of each cylinder 1 is provided with an interconnector 17 which is located at a position where it will always connect the space between slide piston plate 2 and the upper slide piston plate 9A to atmospheric pressure.

Figure 2:
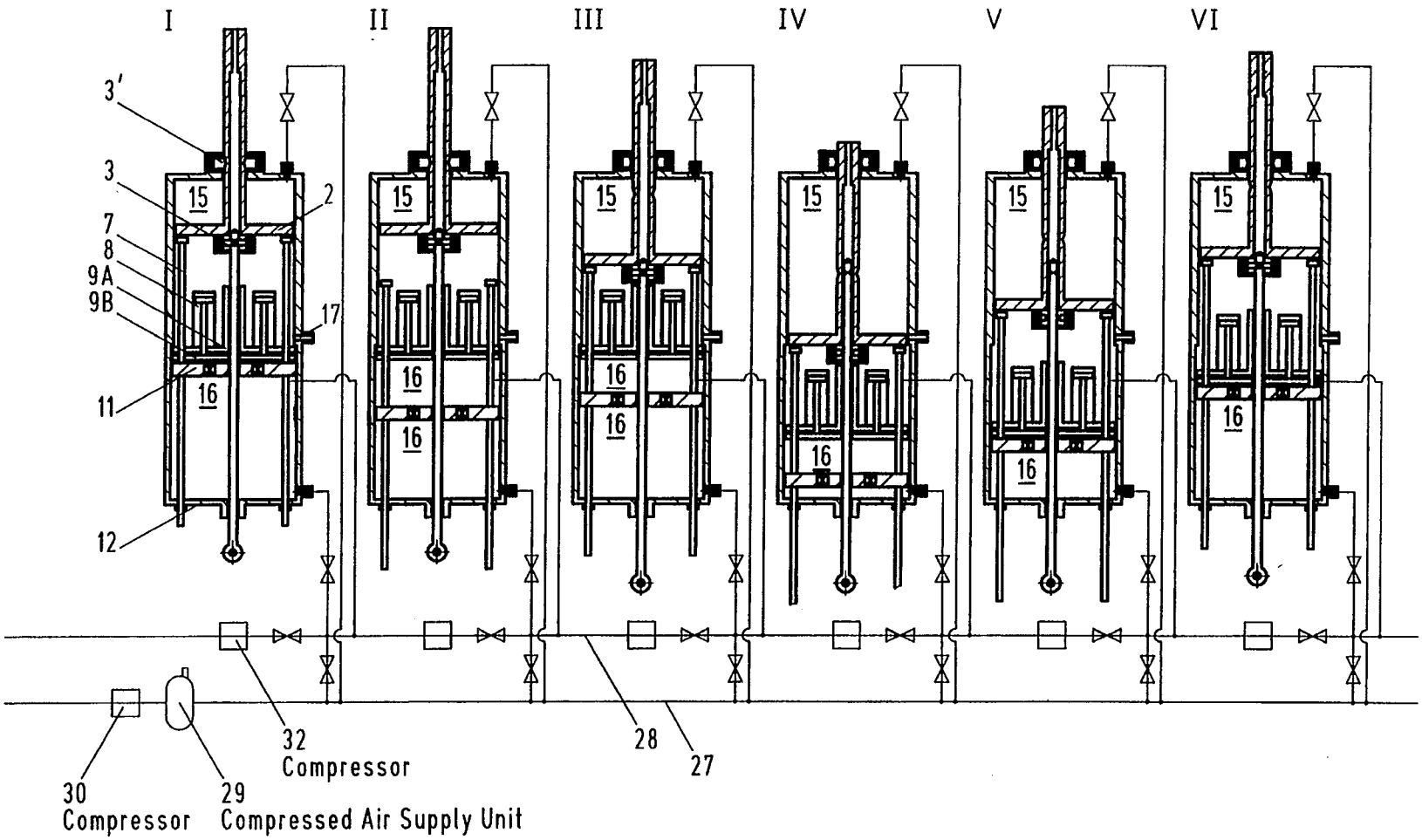
FIG. 2 is a cross-sectional, partially schematic view of a series of six actuating cylinders in an eight cylinder pneumatic engine in accordance with a preferred embodiment of the present invention.

The function of the aerostatic engine will be further described by making reference to FIG. 2. As illustrated in FIG. 2, the actuating unit is provided with eight actuating cylinders I–VIII, with only six of the eight cylinders connected in line being shown in the drawing, with the last two actuating cylinders omitted to enable a better view of the operation.

According to the FIG. 2 embodiment, the aerostatic engine operates on the principle that the pressure volume to be transferred from one pressure diversion chamber 16 to the next pressure diversion chamber 16 is partly effected by aerostatic equalization of pressure and partly provided by small compressors 32, which serve the purpose of increasing the pressure slightly. Here, the value of the pressure of the expanded volume of pressure expansion chamber 15, as well as its degree of expansion, depend on the output of the engine.

In an example of the illustrated embodiment, the engine is operated to impart an initial load in pressure expansion chamber 15 of, for example, 10 bar (approx. 145 psi) to the slide piston plate 2, applied to an area of 100 $cm^2$ (approx. 15.5 $in^2$). The pressure volume in pressure expansion chamber 15 preferably amounts to 1 $dm^3$ (approx. 61 $in^3$) at a pressure of 10 bar (approx. 145 psi).

In order to restore the initial pressure, i.e., the initial value of the pressure volume, for another actuating stroke after the initial pressure volume has expanded in pressure expansion chamber 15, thereby doing work, a pressure volume of 1 $dm^3$ (approx. 61 $in^3$) at a pressure of 12.5 bar (approx. 181 psi), imparting its load to the bottom surface of the slide piston plate 9 over an effective area of 80 $cm^2$ (approx. 12.4 $in^2$), is stored in pressure diversion chamber 16 of the cylinder that is being prepared for the next actuating stroke.

At this stage, with the help of the back pressure of pressure diversion chamber 16, the initial pressure of pressure expansion chamber 15 is restored for the next actuating stroke. In order to control the power of the pressure volume as well of the transfer of the residual pressure volume within the pressure diversion chambers 16 of the individual cylinders, the control cylinders 8 may be actuated by means of aerostatic or hydropneumatic pressure. As this pressure is only residual, it may be produced by means of a hydraulic pump, or in the case of using higher values of pressure for increased engine output a compressor may be used to feed the pressure lines of the control system of control cylinder 8.

The required pressure in the pressure lines of the control system illustrated in FIG. 6, which is needed to actuate the control cylinders 8, is generally almost constant during the entire process because the pressure volume is transferred at a constant value of its volume.

The effective surface of each of the pistons of the control cylinder 8 preferably amounts to 15 $cm^2$ (approx. 2.3 $in^2$). Each of the actuating cylinders is provided with 2 control cylinders 8.

When the residual pressure is to be transferred within pressure diversion chamber 16 in the example being described, the pistons of control cylinders 8, which represent a total effective area of 30 $cm^2$ (approx. 4.6 $in^2$), push the slide piston plate 9B downwardly along a distance of 10 cm (approx. 3.9 in) in order to transfer the remaining pressure from said pressure diversion chamber 16. In this case, the load imparted on slide piston plate 9B amounts to 375 kp (3677 N or approx. 825 lbf) per 80 $cm^2$ (approx. 825 lbf per 12.4 $in^2$). In order to transfer this pressure, the effective area of the pistons of the control cylinders 8 totalling 30 $cm^2$ (approx. 4.6 $in^2$) is loaded with a control pressure of 12.5 bar (approx. 181 psi), which is to be increased in the course of the transfer of the residual pressure to a maximum of 15 bar (approx. 217.15 psi) by means of the inserted small compressors 30'. The cross-sectional areas of the push rods 7 in the described example amount to approx. 10 $cm^2$ (approx. 1.55 $in^2$) each, which means that, with a height of 10 cm (approx. 3.9 in) of the pressure diversion chamber 16 they occupy 200 $cm^3$ (approx. 12.2 $in^3$) of the pressure volume. This results in a total pressure volume of pressure diversion chamber 16 of 1000 $cm^3$ (approx. 61 $in^3$) at a pressure of 12.5 bar (approx. 181 psi).

The preparation phase for the operation of the aerostatic engine will also explained according to FIG. 2. In this preferred embodiment, a defined amount of compressed operating fluid is injected via pressure supply line 27 into pressure expansion chamber 15 by means of compressor 30. The same amount is used in all of the pressure expansion chamber 15. The volume of expansion of the pressure expansion chamber 15 may differ in several of the actuating cylinders I–VIII when the operating process of the aerostatic engine is started. For this reason, the pressure supplied to the various pressure expansion chambers varies according to the volume available in each case as follows. Pressure expansion chamber 15 of cylinder I is provided with 10 bar (approx. 145 psi) at a volume of 1 $dm^3$ (approx. 61 $in^3$). Pressure expansion chamber 15 of the cylinder II is also provided with 10 bar (approx. 145 psi) at 1 $dm^3$ (approx. 61 $in^3$). Pressure expansion chamber 15 of cylinder III is provided with a pressure of 5 bar (approx. 72.5 psi) by compressor 30 as its volume amounts to 2 $dm^3$ (approx. 122 $in^3$), as is evidenced by the position of its slide piston plate 2 in FIG. 2. The volume of pressure expansion chamber 15 of cylinder IV amounts to 3 $dm^3$ (approx. 183 $in^3$) and is accordingly provided with 3.75 bar (approx. 54.4 psi). Pressure expansion chamber 15 of cylinder V is provided by the compressor with 5 bar (approx. 72.5 psi) at a volume of 2 $dm^3$ (approx. 122 $in^3$), while pressure expansion chamber of cylinder VI is provided with 6.25 bar (approx. 90.6 psi) at 1.75 $dm^3$ (approx. 107 $in^3$). Pressure expansion chamber 15 of cylinder VII receives, at this stage, 8.0 bar (approx. 116 psi) at 1.2 $dm^3$ (approx. 73 $in^3$), while pressure expansion chamber 15 of cylinder VIII is provided with 10 bar (approx. 145 psi) at a volume of 1 $dm^3$ (approx. 61 $in^3$).

Pressure diversion chambers 16 of cylinders I and II are provided with a pressure of 12.5 bar (approx. 181.3 psi) at 1.6 $dm^3$ (approx. 98 $in^3$). The same applies to pressure diversion chamber 16 of cylinder III. Pressure diversion chamber 16 of cylinder IV is fully retracted and its pressure volume amounts to zero as its pressure is zero (atmospheric). Pressure diversion chamber 16 of cylinder V is provided with a pressure of 6.25 bar (approx. 90.6 psi) at 0.8 $dm^3$ (approx. 49 $in^3$). Pressure diversion chamber 16 of cylinder VI is provided with 7.8 bar (approx. 113.1 psi) at a volume of 1.1 $dm^3$ (approx. 67 $in^3$). Pressure diversion chamber 16 of cylinder VII is provided with 10 bar (approx. 145 psi) at 1.44 $dm^3$ (approx. 88 $in^3$) while pressure diversion chamber 16 of cylinder VIII is provided with a pressure of 12.5 bar (approx. 181.3 psi) at a volume of 1.6 $dm^3$ (approx. 98 $in^3$).

The pressure in the servo line of control cylinder 8 in the described example amounts to 12.5 bar (approx. 181.3 psi). The servo line, which is operated similarly to the illustrated pressure diversion line 28, is omitted in the drawing in order to prevent the drawing from being overloaded.

The actuating cylinders I–VIII are positioned according to the description above, as illustrated in FIG. 2. In FIG. 2, cylinder I is illustrated in its position prior to the actuating stroke with its pressure expansion chamber fully charged by means of aerostatic pressure. Slide piston plate 2 is locked in its position with the help of locking device 3'. In cylinder II depicted in FIG. 2, the aerostatic pressure in pressure expansion chamber 15 is also fully established while slide piston plate 11, together with the push rods 7, which are integral with slide piston plate 11, are retracted downwardly in order to prevent the push rods 7 from colliding with slide piston plate 2 when pressure expansion chamber 15 is discharged in the subsequent actuating stroke. The volume between slide piston plate 2 and slide piston plate 9A is in constant communication with atmospheric pressure via interconnect or pressure pipe socket 17. At that stage, the solenoid valves c in slide piston plate 11 are open. Slide piston plate 11 is moved downwardly in pressure diversion chamber 16 along a distance corresponding to the distance required for the discharge of pressure expansion chamber 15.

As further shown in FIG. 2, slide piston plate 2 of cylinder III is shown in the position reached after the actuating stroke has been effected, in the course of which locking device 3' is released, allowing slide piston plate 2 to move downwardly into the section below, which has been cleared from push rod 7, until slide piston plate 2 rests on the push rods 7. At that moment, the transfer of the pressure in pressure diversion chamber 16 to the follow-up pressure diversion chambers 16 of the next cylinder is started. This process is effected via pressure diversion line 28 (refer to Table A). Also in FIG. 2, the slide piston plates of cylinder IV are shown in the position they take after the process of discharge is terminated. The solenoid valves c of slide piston plate 11 are open while it is moved down. During this process, the pressure in pressure diversion chamber 16 is transferred to the pressure diversion chamber 16 of its follow-up cylinder. The residual pressure in pressure diversion chamber 16 between slide piston plate 9 and slide piston plate 11 which still exists at this stage may either remain in this space during the entire operation of the whole actuating unit, or, as its value of pressure is low, may be transferred by means of control cylinders 8 powered by compressors 30' to the pressure diversion chamber 16 of the follow-up cylinder.

In cylinder IV, the positions of the slide piston plates are shown after the operating fluid has been transferred completely to the pressure diversion chamber 16 of the follow-up cylinder and the cycle can start again by providing the pressure diversion chamber 16 with new operating fluid.

Illustrated in cylinder V of FIG. 2, is piston rod 5, which is free to move back up again, without load by the crankshaft and the connecting rod, pressure diversion chamber 16, which has given away its pressure, slide piston plates 9 and 11, which are now positioned next to each other in pressure diversion chamber 16, as well as the expanded pressure expansion chamber 15. The push rods 7 of slide piston plate 11 contact slide piston plate 2 at its bottom surface and, once the pressure of the pressure expansion chamber 15 of the follow-up cylinder has expanded, that is, after it has done work and has started its discharge, the aerostatic pressure in pressure diversion chamber 16 may be restored via pressure diversion line 28 (refer to Table A with respect to the constant transfer of pressure). The slide piston plates 9A, 9B and slide piston plate 11 remain in contact while they are moved upwardly, with the solenoid valves c of slide piston plate 11 being closed, while the aerostatic pressure now induced into pressure diversion chamber 16, via pressure diversion line 28, restores the aerostatic pressure in pressure expansion chamber 15, by moving up slide piston plate 2.

FIG. 2 illustrates the state of cylinder VI shortly before it is ready to execute its actuating stroke. Slide piston plate 2, which functions as an actuating piston, is pushed upwardly by the pressure of the transferred operating fluid, until it is arrested through locking device 3' in its upper or top dead center position. A further locking is effected through locking device 3, which connects piston rod 5 to slide piston plate 2.

Cylinders VII and VIII are not illustrated in FIG. 2, in order to prevent the drawing from being overloaded without need. All of the follow-up pressure diversion chambers have the same volume and are provided with the same pressure. This guarantees that each of the actuating cylinders is provided equally with transferred and re-established pressure as far as pressure or pressure volume is concerned.

Actually, it would be possible to restore the pressure in pressure expansion chamber 15 instantly after pressure expansion chamber 15 has expanded, by moving slide piston plate 11 toward slide piston plate 9 with the solenoid valves c closed, however in this case a great amount of energy would be required for this purpose, because the compressive energy in pressure diversion chamber 16 exerts its power in all chambers at the same degree and it is indispensable to transfer the operating fluid contained in the space between slide piston plates 9 and 11 to the spaced between slide piston plate 11 and the rigidly mounted bottom plate 12.

In the illustrated stage of operation, the process of release of pressure is effected through a transfer of the pressure via pressure diversion line 28 into the follow-up cylinders by discharging the aerostatic pressure in pressure expansion chamber 15, and the resulting reduction of aerostatic pressure in pressure diversion chamber 16, while at the same time the aerostatic pressure is transferred and energy is saved.

The residual aerostatic pressure volume, which is transferred by means of compression, is relatively small as far as its volume or pressure is concerned. For this reason a small amount of energy is required to transfer it. It is of importance for the design that the aerostatic pressure in pressure expansion chamber 15 equals the aerostatic pressure in pressure diversion chamber 16 before it is reduced to an average 50% of its initial value when doing work.

In order to guarantee a smooth running of the crankshaft, several units of actuating cylinders connected in line of the kind described above may be applied in parallel.

The method of driving an aerostatic engine using an energy saving system is based on the principle of a drive system which contains a large number, e.g. eight, actuating cylinders I–VIII that are connected in line as shown in FIG. 5.

As is shown in FIG. 1 each of the six illustrated actuating cylinders I–VI, which are connected in line, comprises a shut off pressure expansion chamber 15 in which a quantum of compressed air, which is invariable throughout the entire course of operation and which imparts the aerostatic pressure built up prior to the actuating stroke to the slide piston plate 2, which—via a locking device 3 inside the locking breach 6—is detachably connected to the piston rod 5, which in turn transmits the force to the connecting device of the actuating cylinder.

The top cover of the cylinder is provided with a pressure pipe socket 13, which connects pressure expansion chamber 15 via pressure supply line 27 to an external compressed-air supply unit 29.

The side wall of each cylinder 1 is provided with an interconnector 17 which is located at a position where it may always connect the space between slide piston plate 2 and the upper slide piston plate 9A.

Cylinders 1–VIII include in the section beneath the slide piston plate 2, a pressure diversion chamber 16, which is connected to a pressure supply line 27, which is connected to an external compressed-air supply unit 29 and via solenoid valves to the pressure diversion chambers 16 of the remaining actuating cylinders, and on the other side to a pressure diversion line 28, which is connected via solenoid valves to the pressure diversion chambers 16 of all the other actuating cylinders I–VIII in such a way that the operating fluid compressed in the pressure diversion chamber 16 during the preceding compression stroke is allowed to expand from the pressure diversion chamber 16 to be stored via the pressure diversion line 28 in the pressure diversion chamber 16 of the next actuating cylinder (refer also to Table A), and that in order to restore the aerostatic pressure in pressure expansion chamber 15 for one part the operating fluid stored in the pressure diversion chambers 16 of all following actuating cylinders can be added to pressure diversion chamber 16 via pressure diversion line 28 controlled by means of solenoid valves, and for the other part the operating fluid still required to restore the full initial compression in pressure expansion chamber 15 can be provided by the external compressed air supply unit 29 via the pressure supply line 27, with the result that slide piston plate 2 acting as an actuating piston is moved up again, producing the required aerostatic pressure in pressure expansion chamber 15 necessary for the next compression stroke.

For better understanding Table A is based on the prerequisite for the exemplary embodiment that the values of pressure that can be stored within the pressure diversion chambers 16 and the residual pressure that is necessary to restore the initial pressure in pressure expansion chamber 15 are provided in form of injected energy to the system by a compressor injecting atmospheric air via pressure supply line 27 into pressure diversion chamber 16 after the actuating stroke is completed.

In FIG. 2 cylinder I is illustrated in its position prior to the actuating stroke with its pressure expansion chamber fully charged by means of aerostatic pressure. Slide piston plate 2 is locked in its position with the help of locking device 3'. In cylinder II depicted in FIG. 2 the aerostatic pressure in pressure expansion chamber 15 is also fully established while slide piston plate 11 together with the push rods 7, which are integral parts of it, is retracted downwards in order to prevent said push rods 7 from colliding with slide piston plate 2, when pressure expansion chamber 15 is discharged in the subsequent actuating stroke. The volume between slide piston plate 2 and a slide piston plate 9A is in constant communication with atmospheric pressure via pressure pipe socket 17. At that stage the solenoid valved c in slide piston plate 11 is open.

In FIG. 2 slide piston plate 2 of cylinder III is shown in the position reached after the actuating stroke has been effected, in the course of which locking device 3' is released, allowing slide piston plate 2 to move downwards into the section below, which has been cleared from push rods 7, until slide piston plate 2 rests on the push rods 7.

At that moment the transfer of the pressure in pressure diversion chamber 16 to the follow-up pressure diversion chambers 16 of the next cylinder is started. This process is effected via pressure diversion line 28 (refer to Table A).

Slide piston plate 11 is moved downwards in pressure diversion chamber 16 along a distance corresponding to the distance required for the discharge of pressure expansion chamber 15.

In FIG. 2 the slide piston plates of cylinder IV are shown in the position they take after the process of discharge is terminated. The solenoid valves c of slide piston plate 11 are open while it is moved down.

During this process the pressure in pressure diversion chamber 16 is transferred to the pressure diversion chamber 16 of its follow-up cylinder.

In cylinder V of FIG. 2 of the drawing is illustrated: piston rod 5, which has been moved back up again without load by the crankshaft and the connecting rod, pressure diversion chamber 16, which has given away its pressure, slide piston plates 9 and 11 which are now positioned next to each other in pressure diversion chamber 16, as well as the expanded pressure expansion chamber 15. The push rods 7 of slide piston plate 11 contact slide piston plate 2 at its bottom surface and—once the pressure of the pressure expansion chamber 15 of the follow-up cylinder has expanded, i.e., after it has done work and has smarted its discharge—the aerostatic pressure in pressure diversion chamber 16 may be restored via pressure diversion line 28 (refer to Table A with respect to the constant transfer of pressure). The slide piston plates 9A, 9B and slide piston plate 11 remain in contact while they are moved upwards, with the solenoid valves c of slide piston plate 11 being closed, while the aerostatic pressure now induced into pressure diversion chamber 16 via pressure diversion line 28, restores the aerostatic pressure in pressure expansion chamber 15, by moving up slide piston plate 2. FIG. 2 of the drawing illustrates the state of cylinder VI shortly before it is ready to execute its actuating stroke. Slide piston plate 2, which functions as an actuating piston, is pushed upwards by the pressure of the transferred operating fluid until it is arrested through locking device 3' in its upper dead center. A further locking is effected through locking device 3, which connects piston rod 5 to slide piston plate 2.

In the illustrated stage of operation the process of release of pressure is effected through a transfer of the pressure via pressure diversion line 28 into the follow-up cylinders by discharging the aerostatic pressure in pressure expansion chamber 15 and the resulting reduction of aerostatic pressure in pressure diversion chamber 16, while at the same time the aerostatic pressure is transferred and energy is saved.

The residual aerostatic pressure volume, which is transferred by means of compression, is relatively small as far as its volume or pressure is concerned. For this reason a small amount of energy is required to transfer it.

Figure 3:
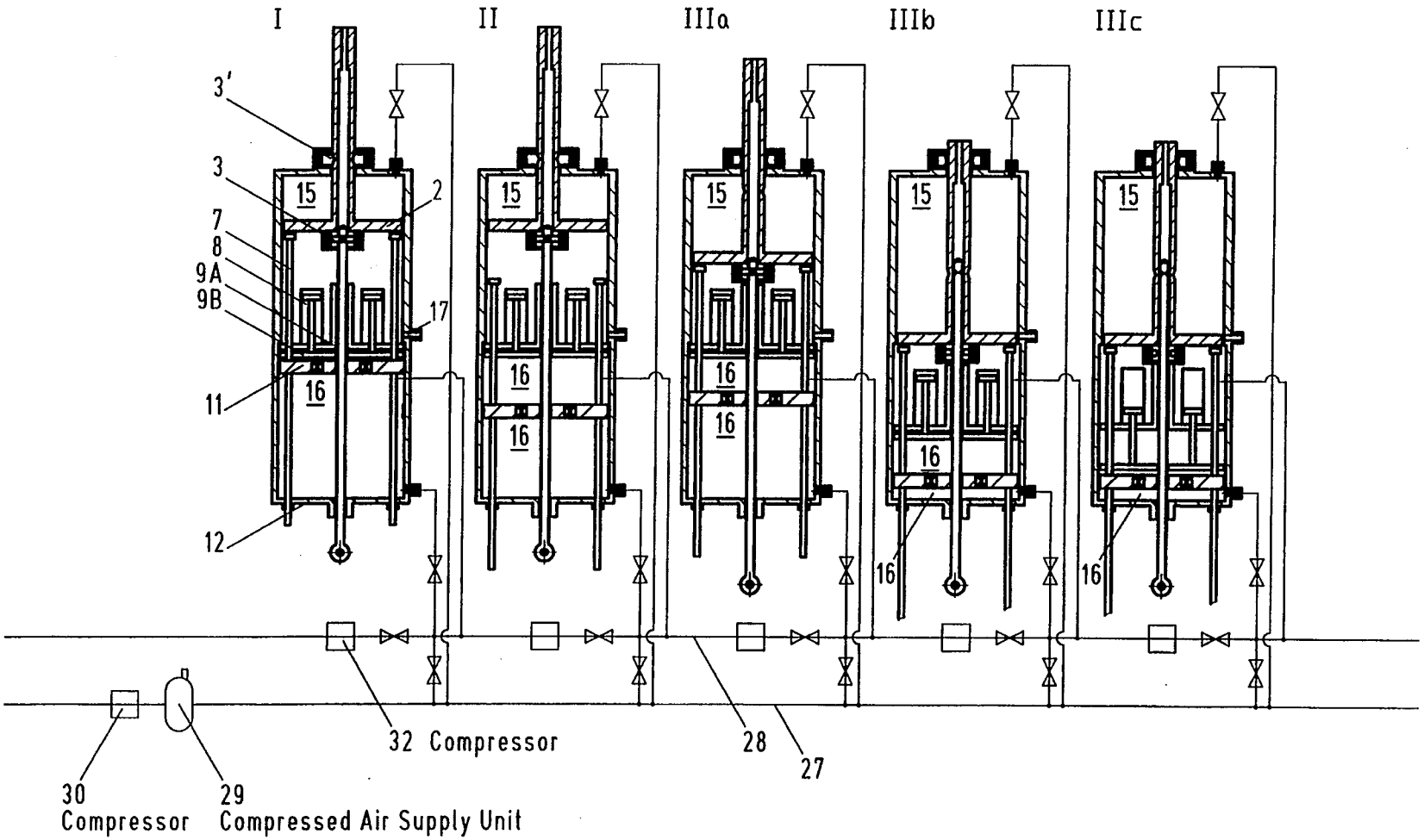
FIG. 3 is a cross-sectional, partially schematic view of the first three actuating cylinders, with the third cylinder being shown at three different stages.

FIG. 3 illustrates a complete actuating stroke of cylinder III, including the transfer of pressure after the compression stroke. The last three illustrated cylinders in FIG. 3 depict cylinder III in its first position IIIa, the subsequent position IIIb and the concluding position IIIc, in the course of which the residual pressure in pressure diversion chamber 16 has been transferred by means of a downward movement of slide piston plate 9B via pressure diversion line 28 to the other pressure diversion chambers 16 to be stored therein. The pressure volume in cylinder III, which represents 100% after the compression stroke of the cylinder III is terminated, is subsequently transferred in three steps as illustrated in FIG. 2. After cylinder III has completed its compression stroke, slide piston plate 9 may remain in locked position until the pressure of the pressure volume of pressure diversion chamber 16 of cylinder III has been reduced to a value smaller than the pressure of the expanded pressure in pressure expansion chamber 15 after the pressure volume in pressure diversion chamber 16 has first been transferred to cylinder VII, then to the cylinders VI to V, and finally to cylinder IV.

It is not until this moment that the locking device of slide piston plate 9 is released to enable the thrust of the pressure still existing in pressure expansion chamber 15 to transfer the pressure in pressure diversion chamber 16 by means of pressure equalization, until, in the example being described a residual volume of 400 $cm^3$ (approx. 24.4 $in^3$) is left. The transfer of this residual volume is effected by moving the pistons 51 of the control cylinders 8 downwardly as shown in cylinder IIIc of FIG. 3.

In order to empty the pressure volume in pressure diversion chamber 16, the value of the control pressure in control cylinder 8 is the increased from 12.5 bar (approx. 181.3 psi) to a maximum value of 15 bar (approx. 217.5 psi) by means of either a small compressor or a hydraulic pump, depending on the operating fluid used.

According to another embodiment, cylinder II may do work due to its stored pressure volume in connection with the local position of its parts by expanding the pressure in pressure expansion chamber 15 from 10 bar (approx. 145 psi) to 5 bar (approx. 72.5 psi) along a distance of 10 cm (approx. 3.9 in). The energy released to the piston rod 5 results from an average force of 750 kp (approx. 1650 lbf) exerted along a distance of 10 cm (approx. 3.9 in).

In the course of this operation, cylinder III (illustrated in FIG. 2) is discharged at a rate corresponding to the decrease of the pressure volume in percentages in pressure diversion chamber 16 of cylinder III, while the pressure in its pressure diversion chamber 16 is transferred to the pressure diversion chambers 16 of cylinders VII, VI, V and VI. The amounts of transferred pressure volumes, which are almost constant during the entire operation, can be taken from FIG. 2 of the drawing.

The sequence of control steps during the period of discharge is illustrated in FIG. 3 of the drawing, and reference should be made also to the foregoing description of the starting-up period.

The total sum of pressure volume stored in cylinder VII during the starting-up period in the described embodiment is calculated as follows: 100% of the pressure volume in cylinder III plus 80% of pressure volume in cylinder VII equal 180%, which is to be divided by 2 chambers, resulting in 90% pressure volume in cylinder VII, that is, a volume of 160 $cm^3$ (approx. 9.8 $in^3$). Residual pressure at a pressure of 12.5 bar (approx. 181.3 psi) in pressure diversion chamber 16 of cylinder III is to be transferred via pressure diversion line 28 to pressure diversion chamber 16 of cylinder VII by means of small compressors 32.

Thus cylinder VII is practically prepared for the actuating stroke, once its push rods 7 are retracted with the solenoid valves of slide piston plate 11 set open. Cylinder I, which in the meantime has just terminated the step described, is now prepared to do work by expanding the pressure of its pressure expansion chamber 15, while in cylinder II the step of discharging pressure diversion chamber 16 is triggered by starting the transfer of its pressure volume into cylinder VII, thus charging the pressure diversion chamber 16 of this cylinder VII with 90% of the required pressure volume, with the lacking 10% of pressure volume to be restored by cylinder II and VI when they are retracted.

As the operation of the aerostatic engine is continuing constantly, the momentary function of operation is shifted successively from one cylinder to the next one to the left, resulting in a cyclic sequence of the described steps. The pressure volume in pressure diversion chamber 16 required for the actuating stroke amounts to 1000 $cm^3$ (approx. 61 $in^3$) at a pressure of 12.5 bar (approx. 181.3 psi) with 80–90% being provided with the help of the internal transfer and 20–10% left over to be restored by small compressor 32. Here the initial volume that has to be provided to the aerostatic engine only one time at the start is not taken into account.

If 20% of the pressure volume is to be transferred between the pressure diversion chambers 16, this corresponds to raising a pressure of 3.75 bar (approx. 54.4 psi) in a volume of approx. 980 $cm^3$ (approx. 59.8 $in^3$) to 12.5 bar (approx. 181.3 psi) in a volume of 320 $cm^3$ (approx. 19.5 $in^3$), related to the expanding phase of the work done during one compression stroke, with approx. 40% of energy required for this process.

Figure 4:
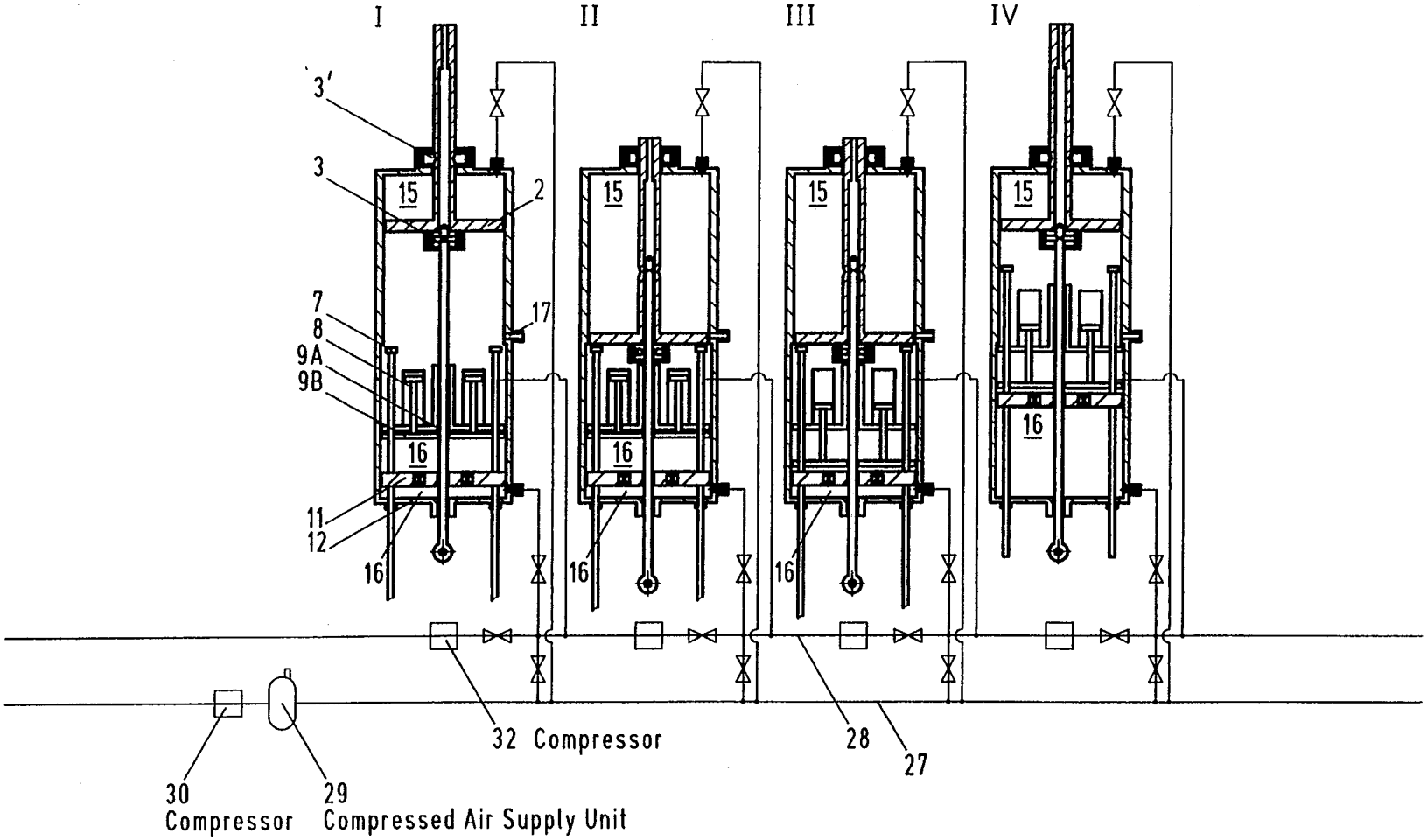
FIG. 4 is a cross-sectional, partially schematic view of a series of four cylinders in an alternative preferred embodiment of the present invention.

According to another embodiment the aerostatic engine functions as illustrated in FIG. 4 of the drawing, the function and type of operation of the aerostatic engine is illustrated without displaying the equalization of pressure within the pressure diversion chambers 16.

As is illustrated here, the momentary size of pressure expansion chamber 15 and the amount of pressure volume needed in pressure expansion chamber 15, as well as the degree to which the pressure volume expands, depend on the required output of the engine.

Slide piston plate 9 can be separated horizontally into a slide piston plate 9A and a slide piston plate 9B. Slide piston plate 9A is provided with an arrester 18 (refer to FIG. 6), which arrests the cylinder housing 50 of control cylinder 8 in such a way that it can slightly move, with its piston 51 mounted rigidly to slide piston plate 9B via piston rod 52. The push rods 7, which are mounted rigidly to slide piston plate 11 and do not pass through slide piston plate 2, slide through both slide piston plate 9A and 9B. The lower prolongations 7' of push rods 7 sliding through bottom plate 12, serve to prevent pressure buildup or release as a result of the change in volume effected by the presence of their sections above slide piston plate 11, when slide piston plate 11 is moved up or down. All of the valves, switches and locking devices are controlled electrically.

When the aerostatic engine in an example of this embodiment is operated, an initial load of 10 bar (approx. 145 psi) applied to an area is imparted to the surface of 100 $cm^2$ (approx. 15.5 $in^2$) of the slide piston plate 2. The pressure volume in pressure expansion chamber 15 amounts to 1 $dm^3$ (approx. 61 $in^3$) at a pressure of 10 bar (approx. 145 psi). The distance the piston travels while it is doing work amounts to 40 cm (approx. 15.7 in), with a resulting pressure volume of 14 $dm^3$ (approx. 854 $in^3$) at 80 bar (approx. 1160 psi) in pressure expansion chamber 15.

The work is done by exerting a force of 9 t (approx. 9.9 sh tn) along a distance of 40 cm (approx. 15.7 in). The bottom side of slide piston plate 9 in pressure diversion chamber 16 is loaded with a pressure of 122 bar (approx. 1769 psi) at an area of 80 $cm^2$ (approx. 12.4 $in^2$). This corresponds to the initial load on slide piston plate 2 on the side of pressure expansion chamber 15. Due to the provision of this initial load, it is also guaranteed that slide piston plate 2 can be moved up again, restoring the initial pressure in pressure expansion chamber 15 for another actuating stroke.

To prevent the pressure in the pressure diversion chambers 16 from decreasing while it is transferred, an aerostatic or hydro-aerostatic pressure of 225–235 bar (approx. 3260–3400 psi) is used to control the power of transfer of the pressure.

The cross-sectional areas of the pistons of the control cylinders 8 amount to 20 $cm^2$ (approx. 3.1 $in^2$) each.

Each of the actuating cylinders is equipped with two control cylinders 8, with the result that the high pressure imparted on an area of 40 $cm^2$ (approx. 6.2 $in^2$) effects a control load of approx. 9 t (approx. 9.9 sh tn) on the pressure volume in pressure diversion chambers 16 during the transfer of pressure. The high-pressure control line is also interconnected to a small compressor and to a pressure vessel. With help of piston 51 of control cylinder 8, the high-pressure control line provides a constant high-pressure while the direction of the control in control cylinder 8 is reversed, with this pressure being increased by a few bar (i.e. psi) in order to allow the transfer of the pressure volume in the actuating cylinder within its pressure diversion chamber 16. The high-pressure control line connected to control cylinder 8 is not illustrated, for the sake of clarity.

The preparation phase for the operation of the aerostatic engine will now be discussed in connection with FIG. 4. According to the FIG. 4, a pressure volume of 10 $dm^3$ (approx. 610 $in^3$) at a pressure of 100 bar (approx. 1450 psi) is injected into pressure expansion chamber 15 of cylinder I and IV corresponding to the momentary position of the slide piston plates 2.

The pressure expansion chambers 15 of cylinders II and III are provided with a pressure of 80 bar (approx. 1160 psi) at a volume of 14 $dm^3$ (approx. 854 $in^3$).

In these two pressure expansion chambers 15 of the example being described, the local parts of the cylinders are in fully expanded position. The pressure volume in all pressure expansion chambers is the same. The slide piston plates 2 in cylinder I and IV are loaded on the side of pressure expansion chamber 15 with a pressure of 100 bar (approx. 1450 psi) corresponding to a force of 10 t (approx. 11 sh tn). In the pressure expansion chambers 15 of cylinder II and III, which are expanded, a pressure of 80 bar (approx. 1160 psi) corresponding to a force of 8 t (approx. 8.8 sh tn) is imparted to an area of 100 $cm^2$ (approx. 15.5 $in^2$). The distance of expanding the pressure amounts to 40 cm (approx. 15.7 in) while the rate of expansion of the pressure volume in pressure expansion chamber 15 is 20%.

According to the position of the slide plates in cylinders I and II the pistons of the control cylinders 8 are in their upper positions, whereas they are in their retracted positions in cylinders III and IV. It is to be noted that slide piston plate 9 can be moved freely to its upper position of locking while the pressure volume is transferred from pressure diversion chamber 16 to the next pressure diversion chamber 16.

As a result of this, the pistons of the control cylinders 8, which according to the illustrated cylinder IV are retracted when the pressure diversion chambers 16 are to be charged, are allowed to move freely in a vertical direction together with slide piston plate 9B.

As soon as slide piston plate 2 has reached its compression position, where it is locked by locking device 3', the high servo pressure in the control cylinders 8 is changed over with the result that, while slide piston plate 9B is arrested, the freely movable slide piston plate 9A moves downwards to contact slide piston plate 9B, while at the same time slide piston plate 11 moves vertically downwardly together with its push rods 7.

Before the actuating stroke in any of the actuating cylinders 1 can be executed by slide piston plate 2 moving downwardly it is necessary to move slide piston plate 11 downwardly with its valves c opened to prevent resistance in pressure diversion chamber 16 for a distance corresponding to the distance required for the actuating stroke. This is effected mechanically by means of a rack and pinion device 33 which is located underneath bottom plate 12 and which is powered by the crankshaft.

In the above description, the preparatory phase of running the engine has been explained according to FIG. 4. In the following discussion, the operational phase subsequent to the preparatory phase will be described according to an example of the same FIG. 4 embodiment.

When locking device 3' is opened, slide piston plate 2 together with piston rod 5, which is locked to slide piston plate 2 via locking device 3, starts to move vertically downwardly until it touches the control cylinders 8.

In this phase, the piston rods 52 of the control cylinders 8 are pushed downwards due to the fact that now the control pressure exerted on the top surface of the piston of control cylinder 8 in increased by a few bars by means of a small compressor.

The high pressure piston is now moved vertically along a distance of a few millimeters (hundredths of an inch) within the vertical sliding path mounted on slide piston plate 9A, with the sliding path including an arrester 18 guiding the control cylinders 8, with the result that, for one part, mechanical pressure is exerted on cylinder housing 50 of control cylinder 8 via slide piston plate 2 being moved downwards due to the expanding pressure of pressure expansion chamber 15, and for the other part, the piston rods 52 being extended from control cylinder 8 are exerted to an equivalent back pressure exercised on them by slide piston plate 9B. At that time, the pressure volume of pressure diversion chamber 16 of cylinder II is transferred to cylinder III by means of a the small compressor 32. During this phase, the pressure volume of pressure expansion chamber 15 of cylinder III is being compressed again for the reestablishment of the pressure required for the next actuating stroke, by reducing the expansion-volume of pressure expansion chamber 15, thus increasing the pressure, with the mechanical lock being activated as soon as said values are accomplished.

In the course of the above process, the control pressure in control cylinder 8 is reversed, with the result that the pistons of control cylinders 8 are retracted, with slide piston plate 9A at the same time being moved vertically downwardly until it touches slide piston plate 9B, as has been discussed above. In this process, the control cylinders 8 are consequently moved vertically downwards as well. In addition, the push rods 7 are retracted by slide piston plate 11 moving downwardly with its valves c opened. At that moment the actuating stroke of cylinder IV is started, that is, work is being done due to the fact that slide piston plate 2 moves downwardly after the lock in locking device 3' has been released. The steps discussed above, carried out in each corresponding cylinder, are then passed on to the next corresponding cylinder to the left in the subsequent phase of the cycle according to FIG. 4.

The phase of pressure expansion during which work is done within a cylinder is executed in a shorter period of time than the transfer of pressure among the remaining cylinders. This is due to the corresponding cross-sectional area of pressure of diversion line 28 as well as to the correspondingly low rate of transfer in relation to the force of the expansion. For this reason, it is preferred that the cross-sectional areas of all pressure lines be dimensioned as large as possible and the row of in-line cylinders illustrated in FIG. 4 be interconnected in parallel several times, including the option of staggering the individual stages of pressure expansion to guarantee smooth performance of the crankshaft.

Furthermore, the process described above may also be carried out using two separate pressure diversion lines 28, with one of the pressure diversion lines 28 transferring the potential energy in percentages of pressure volume by pressure equalization, and the other pressure diversion line 28 transferring the energy parallel to the first one via a diversity compressor. Another way of realizing the transfer of the total potential energy by transferring the pneumatic pressure via a pressure diversion line 28 may be effected by using a diversity compressor within the pneumatic system, whether it be a reciprocating or centrifugal compressor, the compression chambers of which being provided with pipe connections that contain non-return valves. Said pipe connections are connected to pressure diversion line 28 in such manner that the required nominal pressure at the pressure pipe connection, which varies constantly due to the transfer of potential energy while pressure is established in pressure diversion chamber 16, may be economically induced, according to the pressure needed, into pressure diversion line 28, from where it is passed on to the corresponding pressure diversion chambers 16.

Furthermore, the low pressure steadily varying in the corresponding pressure diversion chamber 16, from where the operating fluid is to be transferred, is to be applied alternately to the chambers of the diversity compressor, which effect the compression.

Due to this fact, energy required to drive the compressor is saved, while at the same time the potential energy that is transferred without using up energy via or through the compressor does not have a negative effect on the required transfer of pressure provided by means of the diversity compressor or, as the case may be, by means of several diversity compressors. In other words, the diversity compressor is designed to transfer part of the stored energy from cylinder I to the cylinders III to VIII for further exploitation.

In this case the potential energy to be transferred to the cylinders III to VIII via pressure diversion line 28 is to be bypassed via a buffer vessel, the volume of which should be at least ten times bigger than the swept volume of the compressor. The timing of the removal of the pressure volume from cylinder I as well as the additional injection of operating fluid compressed at a pressure of, for example, 11 bar to the cylinders III to VIII, with specific control devices observing the mentioned parameters proposed for the design of the diversity compressors.

If the swept volume of the cylinder of the buffer is ten times as big, the pressure will vary only by approximately one bar. Alternatively, the pressure may be allowed to flow from the buffer to the specific pressure diversion chamber 16, the piston of which is in advance, before pressure is provided from cylinder I. This pressure is part of the reserved pressure established in the course of the compression stroke that was executed two cycles before.

The aerostatic engine of the present invention operates on the principle that work is done by the pressure in the pressure expansion chamber 15 of the individual cylinders as said pressure moves slide piston plate 2 down in the phase of expansion, is expected to regain and thus provide efficiently the energy that has been stored in the pressure diversion chambers 16 of the individual cylinders. In the course of expansion, the work being done decreases constantly as the distance of expansion increases. This is why it is indispensable to use a diversity compressor, the purpose of which is to induce this energy at differing amounts to the corresponding pressure diversion chamber 16 of the cylinders according to the varying nominal output.

Accordingly, the energy provided to the pressure diversion chambers 16 at a low rate can be used as effective power at a much higher ratio, provided the parameters of the design of a diversity compressor are selected appropriately, i.e., the connecting sockets of the chambers within the individual levels of compression being connected to pressure diversion line 28 via non-return valves integrated in the circuit and directing the pressure flow to the pressure diversion line 28, and the low-pressure in pressure diversion chamber 16, where the compressed operating fluid comes from, with said low pressure varying in the course of the equalization or transfer of pressure, is alternately applied within the compressor to the areas of the parts which contribute to the compression.

If the pressure of the operating fluid in the pressure diversion chamber 16 of one of the cylinders is not reduced down to a value of 1 bar in the course of pressure transfer to the follow-up cylinders, that is, if a residual pressure of several bars still prevails therein, the slide piston plates 9A and 9B may be separated by means of the activated control cylinder 8 and the remaining pressure volume will then be transferred to the corresponding follow-up cylinder, thus maintaining a constant level of pressure.

If the parameters of the pressure transfer are increased, this is not disadvantageous with regard to the parameters of the transfer of pressure that is carried out constantly in combination with the equalization of pressure that the power required by the compressor depends on.

The aerostatic engine can be driven by an internal combustion engine connected in series to it.

An electric motor with an aerostatic engine coupled at its outlet side in order to provide energy, can be joined with a generator being driven by the aerostatic engine.

The diversity compressor may be replaced by a hydraulic pump, provided each of the pressure diversion chambers 16 of the cylinders in the aerostatic engine is equipped with a hydraulic accumulator into which the operating fluid expanding from pressure diversion chamber 16 is able to flow, thus transferring the exertion of the corresponding nominal pressure to the hydraulic oil. The hydraulic oil, which in this case is transferred within the pressure diversion chamber 16 and pumped back into the tank by means of the hydraulic pump, is thus prepared to compress again the corresponding operating fluid of the corresponding pressure diversion chambers 16. In connection with this embodiment, it is important to note that the pressure in the pressure-providing pressure diversion chamber 16 is not allowed to decrease down to the value of 1 bar neither during the transfer of pressure nor during its equalization.

The value of the pressure of the operating fluid to be transferred by means of the control cylinders 8, with the slide piston plates 9A and 9B being separated, should range at a medium level. The power required for the hydraulic pump also depends on the average load exerted during the process of the pressure transfer.

With respect to the performance of the actuating cylinders, it is desirable in each individual case to dimension the volume of the pressure expansion chambers 15 to correspond to a certain degree to the volume of the pressure diversion chambers 16.

If the temperature of the actuating cylinders should increase above a defined level of permissible operating temperature, the included cooling system will be activated by means of a sensor.

TABLE A

Pressure Release and Pressure Transfer Between the Pressure Diversion Chambers or Actuating Cylinders in Their Percentages of Volume

| | Actuating Cylinder | | | | | | | |
|---|---|---|---|---|---|---|---|---|
| | I | II | III | IV | V | VI | VII | VIII |
| | Compression | | | | | | | |
| 1 | by Co 100.00 Work | by Co 100.00 Work | | | | | | |
| 2 | Rel | | R b 1 50.00 by Co 50.00 | R b 1 25.00 | R b 1 12.50 | R b 1 6.25 | R b 1 3.12 | R b 1 1.56 |
| 3 | R b 2 3.50 | Rel | Work | R b 2 62.5 by Co 37.50 | R b 2 37.55 | R b 2 21.90 | R b 2 12.50 | R b 2 7.03 |
| 4 | R b 3 10.98 | R b 3 5.45 | Rel | Work | R b 3 68.77 by Co 31.23 | R b 3 45.33 | R b 3 28.91 | R b 3 18.47 |
| 5 | R b 4 22.80 | R b 4 14.12 | R b 4 7.06 | Rel | Work | R b 4 72.66 by Co 27.34 | R b 4 50.77 | R b 4 34.62 |
| 6 | R b 5 38.90 | R b 5 26.50 | R b 5 17.50 | R b 5 8.25 | Rel | Work | R b 5 75.38 by Co | R b 5 55.00 |

TABLE A-continued

| Pressure Release and Pressure Transfer Between the Pressure Diversion Chambers or Actuating Cylinders in Their Percentages of Volume | | | | | | | | |
|---|---|---|---|---|---|---|---|---|
| | Actuating Cylinder | | | | | | | |
| | I | II | III | IV | V | VI | VII | VIII |
| 7 | R b 6 58.20 | R b 6 42.35 | R b 6 29.92 | R b 6 19.90 | R b 6 9.90 | Rel | 24.62 Work | R b 6 77.50 by Co 22.50 |
| 8 | R b 7 79.10 by Co 20.90 | R b 7 60.72 | R b 7 45.32 | R b 7 32.56 | R b 7 21.23 | R b 7 10.21 | Rel | Work |
| 9 | Work | R b 8 80.36 by Co 19.64 | R b 8 62.84 | R b 8 47.70 | R b 8 34.46 | R b 8 33.88 | R b 8 11.64 | Rel |

by Co = provided by the compressor
R b = (pressure) release by pressure diversion chambers
In the sequence of the actuating strokes the values to be provided by the compressor decrease continuously and finally stagnate.

I claim:

1. A pneumatic engine device comprising:

a drive-unit system including a plurality of actuating cylinders connected in line, each of said actuating cylinders further comprising:

an airtight pressure expansion chamber bounded at one end by a movable piston plate;

means for filling said pressure expansion chamber with a predetermined amount of compressed air, and means for sealing said pressure expansion chamber;

a pressure diversion chamber, means for connecting said pressure diversion chamber of an actuating cylinder to pressure diversion chambers disposed in each of said plurality of actuating cylinders, said pressure diversion chamber in each of said actuating cylinders having means for connecting said pressure expansion chamber to an external air supply unit;

means for selectively controlling air flow to selectively transfer air through pressure equalization between said pressure diversion chambers, and between each of said plurality of pressure diversion chambers and said external air supply unit;

a piston rod, means for releasably locking said piston rod to said movable piston plate;

means for releasably locking said movable piston plate at a top dead center position in said actuating cylinder, such that when said piston plate is released from said piston rod by said releasable locking means, said piston plate will move along a distance in said cylinder in response to expansion of a predetermined amount of compressed air to be filled into said pressure expansion chamber;

means for returning said piston plate to its locked position on said piston rod and thus for re-establishing an aerostatic pressure in said pressure expansion chamber generated by said predetermined amount of compressed air to be filled into said pressure expansion chamber, said piston plate returning means comprising said pressure diversion chamber, said air flow controlling means, air introduced into said pressure diversion chamber by pressure equalization induced by said air flow controlling means, and a small compressor means to make up the remainder of the air pressure not provided to said pressure diversion chamber by pressure equalization.

2. A device according to claim 1 wherein said piston plate in each of said actuating cylinders functions as an actuating piston which sealingly bounds said pressure expansion chamber, said device further comprising said piston rod running in a guiding bore means for releasably locking said piston rod to said piston plate in a locking breech, a first slide plate means located at a defined distance below said piston plate for defining an upper boundary of said pressure diversion chamber; and a second slide plate means located underneath said first slide plate means having solenoid control valves therein, and wherein said pressure diversion chamber is closed at its bottom end by means of a bottom plate.

3. A device according to claim 2 wherein said guiding bore is rigidly mounted to said piston plate and a guide sleeve through which said guiding bore traverses can be arrested at, as well as released from, a housing of said cylinder by said piston plate locking means.

4. A device according to claim 3 wherein said filling means comprises, in a housing of each of said plurality of actuating cylinders, a first pressure pipe socket leading into said pressure expansion chamber of each of said actuating cylinders; and each said cylinder housing is furthermore provided with a second pressure pipe socket leading into pressure diversion chamber of said cylinder with both said first and second sockets being in communication with said external compressed-air supply unit via a pressure supply line; and wherein the side wall of each cylinder is provided with an interconnector means located at a predetermined position for constantly connecting the space between said piston plate and an upper slide plate of said first slide plate means to atmospheric pressure.

5. A device according to claim 4 wherein said pressure diversion chamber of each of said actuating cylinders is connected to the pressure diversion chambers of the remaining said cylinders via a pressure diversion line.

6. A device according to claim 5 wherein said first slide plate means is divided into said upper slide plate and a lower slide plate, said upper slide plate being mounted to a cylinder housing of a control cylinder that can be loaded with pressure from a pressure vessel, and said lower slide plate is mounted to a control cylinder piston rod, said piston rod control cylinder being adapted to selectively and reversibly push said piston up or down.

7. A device according to claim 6 wherein said second slide plate means is provided with push rods (7) extending at both sides of said second slide plate means and mounted rigidly to it, with upper parts of said push rods (7) running slidingly through pressure sealed openings in said upper and lower slide plates of said first slide plate means and said push rods having lower prolongations running slidingly through pressure sealed openings in said bottom plate.

* * * * *